US006919884B2

(12) United States Patent
Mix et al.

(10) Patent No.: US 6,919,884 B2
(45) Date of Patent: Jul. 19, 2005

(54) SIMULATED FIREPLACE INCLUDING ELECTRONIC DISPLAY

(75) Inventors: Devin Eugene Mix, Lakeville, MN (US); Thomas J. Bachinski, Lakeville, MN (US); Dan Curtis Shimek, Apple Valley, MN (US); David Charles Lyons, Red Wing, MN (US); Mark Richard Schroeder, Prior Lake, MN (US)

(73) Assignee: HON Technology Inc., Muscatine, IA (US)

( * ) Notice: Subject to any disclaimer, the term of this patent is extended or adjusted under 35 U.S.C. 154(b) by 256 days.

(21) Appl. No.: 10/120,889

(22) Filed: Apr. 10, 2002

(65) Prior Publication Data

US 2003/0201957 A1 Oct. 30, 2003

(51) Int. Cl.[7] ..... G09G 3/36

(52) U.S. Cl. ..... 345/204; 348/589; 348/600; 40/427; 40/428

(58) Field of Search ..... 345/60, 87, 204, 345/690; 348/589, 600; 431/125; 40/427, 428

(56) References Cited

U.S. PATENT DOCUMENTS

| | | | | |
|---|---|---|---|---|
| 3,582,961 A | | 6/1971 | Shindo | |
| 3,978,598 A | | 9/1976 | Rose et al. | |
| 4,573,905 A | * | 3/1986 | Meyers | 431/125 |
| 4,890,600 A | * | 1/1990 | Meyers | 126/512 |
| 4,927,238 A | | 5/1990 | Green et al. | |
| 5,032,766 A | | 7/1991 | Gundlach et al. | |
| 5,195,820 A | * | 3/1993 | Rehberg | 126/523 |
| 5,291,297 A | | 3/1994 | Steinmeyer | |
| 5,469,839 A | * | 11/1995 | Kasulis et al. | 126/552 |
| 5,642,580 A | | 7/1997 | Hess et al. | |
| 5,787,618 A | * | 8/1998 | Mullis | 40/219 |
| 5,823,784 A | * | 10/1998 | Lane | 434/226 |
| D410,346 S | | 6/1999 | Kerr | |
| 6,050,011 A | * | 4/2000 | Hess et al. | 40/428 |
| 6,053,165 A | | 4/2000 | Butler et al. | |
| 6,129,079 A | * | 10/2000 | French et al. | 126/502 |
| 6,157,424 A | | 12/2000 | Eichenlaub | |
| 6,219,040 B1 | * | 4/2001 | Kotha et al. | 345/211 |
| 6,363,636 B1 | * | 4/2002 | Hess et al. | 40/428 |

FOREIGN PATENT DOCUMENTS

GB 2 307 132 * 5/1997

* cited by examiner

*Primary Examiner*—Henry N. Tran
*Assistant Examiner*—Jean Lesperance
(74) *Attorney, Agent, or Firm*—Merchant & Gould P.C.

(57) ABSTRACT

A fireplace generally including a display driven by a controller. The display may be configured to show images associated with a fireplace. The images may be in two dimensions or three dimensions. The display may be driven by the controller, and a user interface may be provided to configure the fireplace. The display may also be driven by other peripheral components as well. The display may optionally be a flat-panel display. The display may be placed against a wall of a structure and surrounded by a decorative facade, or may be placed in an enclosure of a wall. Various optional components, such as a simulated electric glowing ember system and a retractable grate and artificial log set, may also be included.

30 Claims, 7 Drawing Sheets

SIMULATED FIREPLACE INCLUDING ELECTRONIC DISPLAY

TECHNICAL FIELD

The present invention relates to fireplaces. More particularly, the invention relates to a simulated fireplace including a display and controller.

BACKGROUND

Fireplaces have become increasingly commonplace in homes, businesses, and other buildings. A fireplace may provide many benefits, including the creation of an aesthetically-pleasing arrangement of flames and sounds. A variety of different types of fireplaces are available, including solid-fuel, gas, and electric. Each type of fireplace is typically mounted in an enclosure defined by a wall of a structure.

While the advantages of a fireplace are apparent, there are also disadvantages in the installation, use, and maintenance of a fireplace. Installation of a fireplace may be costly and time consuming, requiring the creation of a hole in a wall, an exhaust structure to exhaust combusted air, and the installation of the various components of the fireplace itself. Further, the space requirements of a conventional fireplace can be prohibitive. Also, use of the fireplace can be inconvenient, requiring, for example, the replacement of fuel if the fireplace is a solid-fuel burning fireplace. In addition, maintenance for a fireplace can be costly.

Therefore, it would be desirable to create a fireplace that can provide the typical benefits of a fireplace while reducing installation, size, use, and maintenance costs.

SUMMARY

Generally, the present invention relates to fireplaces. More particularly, the invention relates to a simulated fireplace including a display and controller.

In one aspect, the invention relates to a simulated fireplace including a flat-panel display configured to show images of a simulated fire, and a controller coupled to the display to drive the display with the images of the simulated fire.

In another aspect, the invention relates to a combination simulated fireplace and family entertainment center including an enclosure, a display disposed within the enclosure and configured to show images in three dimensions, and a controller coupled to the display to drive the display.

In yet another aspect, the invention relates to a method of simulating a fireplace comprising steps of: providing a flat-panel display configured to show images in three dimensions; providing a decorative facade surrounding the display; placing the flat-panel and decorative facade adjacent a wall of a structure to simulate a fireplace; and driving the display with images of a fire.

In another aspect, the invention relates to a method of simulating a fire including steps of: providing a flat-panel display configured to show an image of the fire in three dimensions; providing a controller to drive the image of the fire displayed on the flat-panel display; and providing an interface coupled to the controller to input information that controls the image of the fire.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
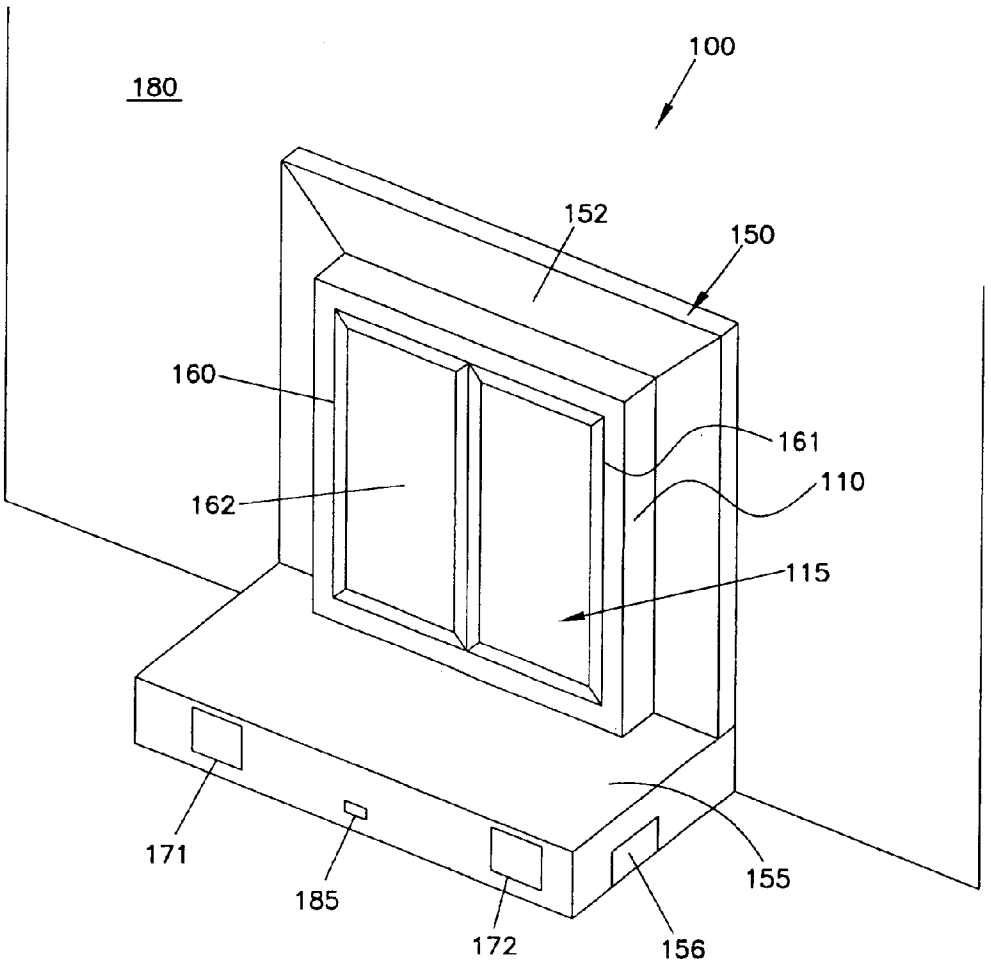
FIG. 1 is a schematic front perspective view of an example fireplace made in accordance with the present invention.

While the invention is amenable to various modifications and alternate forms, specifics thereof have been shown by way of example and in the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The invention is applicable to fireplaces. More particularly, the invention relates to a simulated fireplace including a display and controller. While the present invention is not so limited, an appreciation of the various aspects of the invention will be gained through a discussion of the examples provided below.

Example fireplaces made in accordance with this invention may generally include a display driven by a controller. The display may be configured to show images associated with a fireplace. The images may include, without limitation, images of flames, fuel (e.g., wood), glowing embers, ashes, grates, etc. The images may be in two dimensions or three dimensions. As used herein, the term "images" may include still or motion images. The display may be driven by the controller, and a user interface may be provided to configure the simulated fireplace. The display may also be driven by other peripheral components as well.

I. First Embodiment

Figure 2:
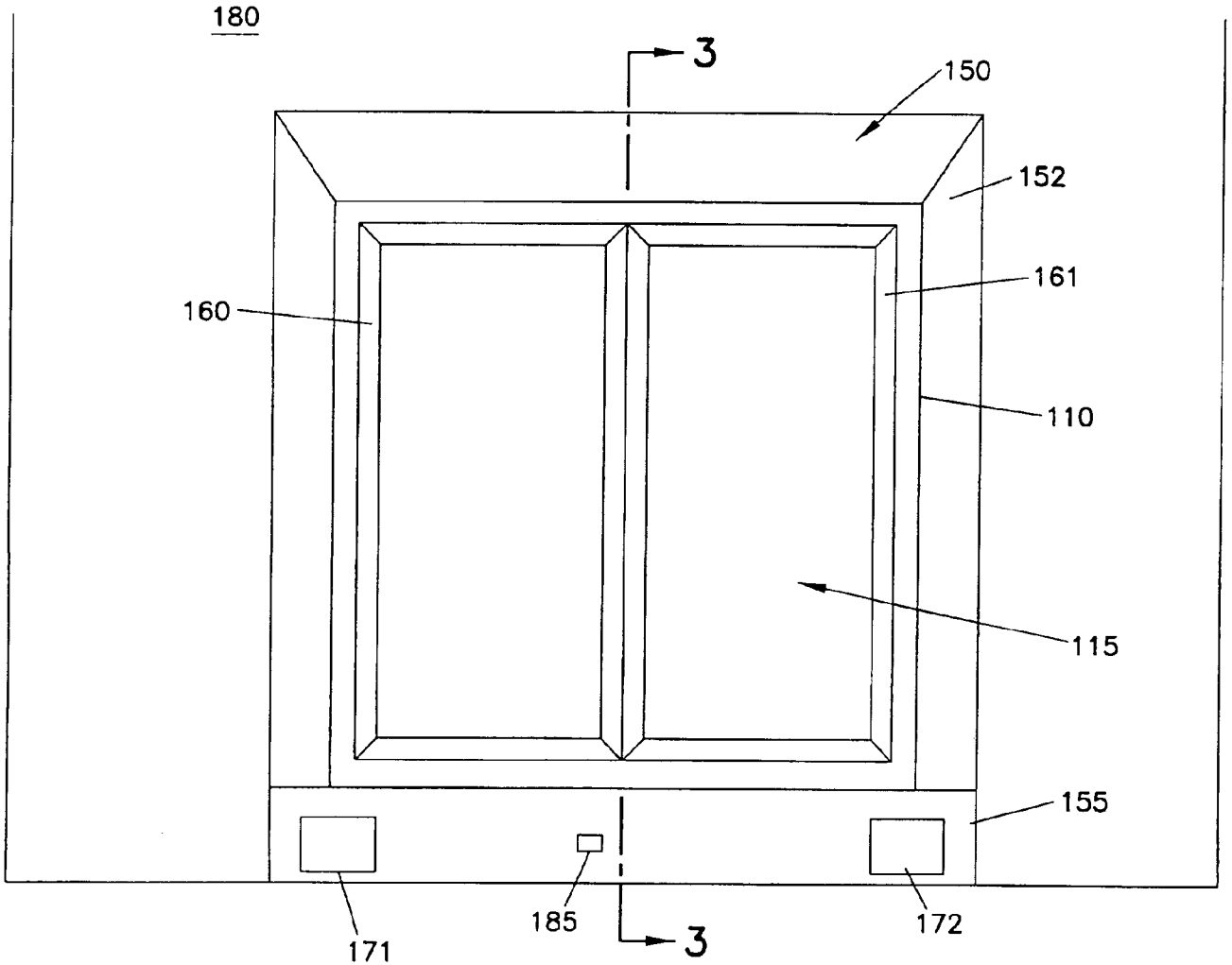
FIG. 2 is a schematic front view of the fireplace of FIG. 1.
Figure 3:
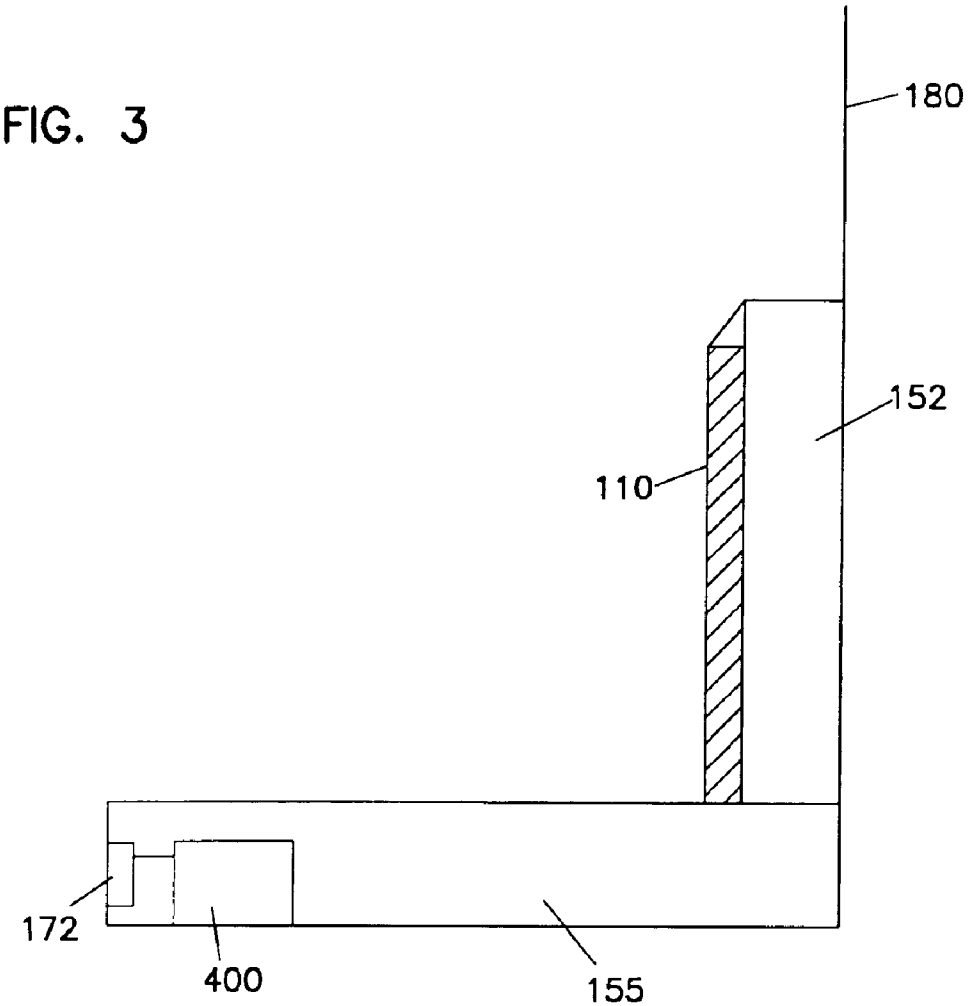
FIG. 3 is a schematic cross-sectional view of the fireplace taken along line 3—3 of FIG. 2.
Figure 4:
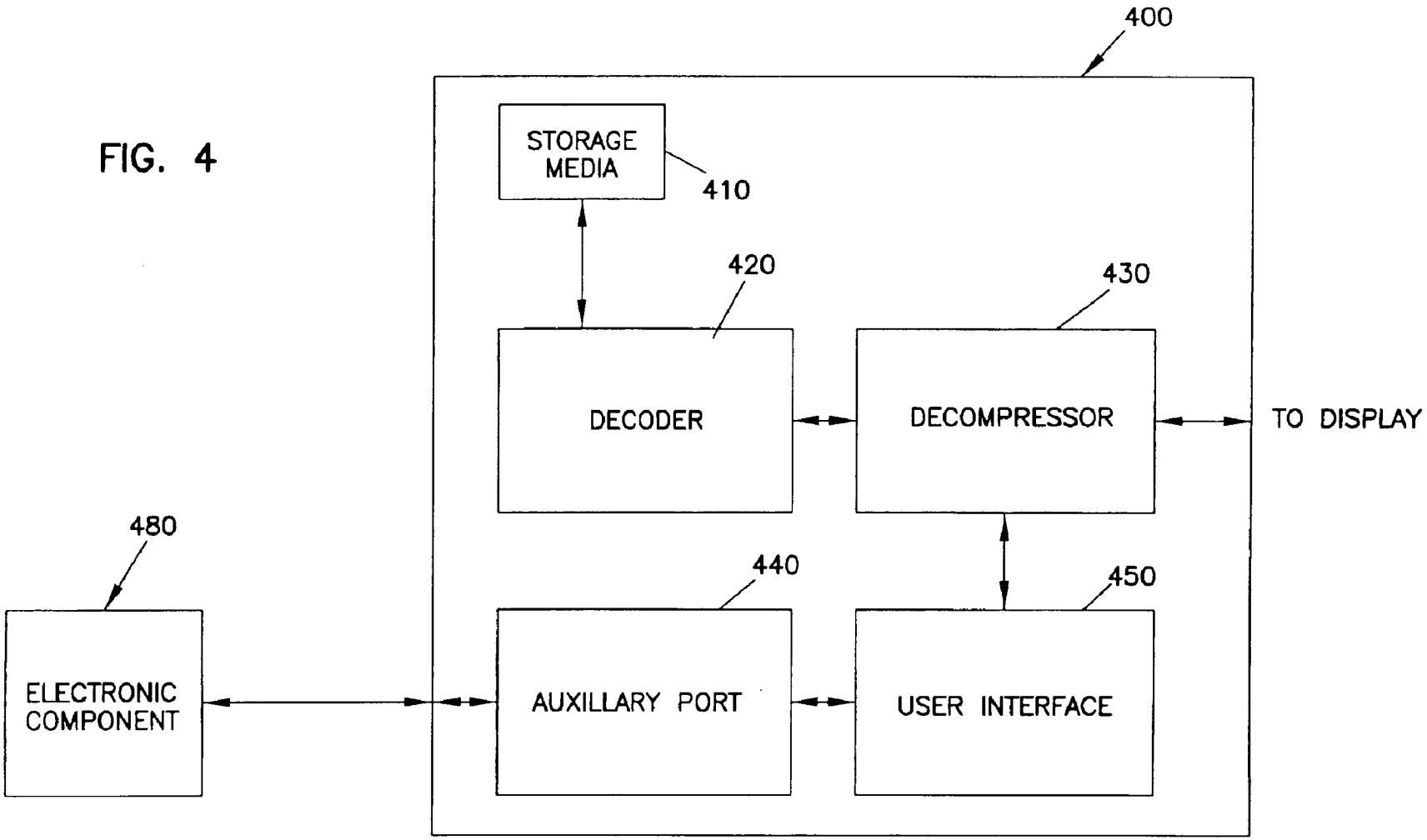
FIG. 4 is a schematic view of an example embodiment of a controller used to drive a display made in accordance with the present invention.

In a first embodiment, an example fireplace 100 is shown in FIGS. 1–3. The fireplace 100 generally includes a display 110 and a controller 400 (shown in FIGS. 3 and 4). Each of the various components comprising the fireplace 100 is described below.

A. Display

The example display 110, with screen 115, is a flat-panel display and may be, for example, a liquid crystal display (LCD), a plasma display, or a light-emitting diode (LED)

display. Other types of flat-panel displays can also be used. The display 110 may be coupled to and driven by the controller 400. The display 110 may optionally be coupled to and driven by various other electronic components (referred to herein as peripheral components) such as, for example, a DVD player and a computer, as described below.

The display 110 may be a flat-panel display for showing images in two dimensions. Flat-panel displays that show images in two dimensions are well known in the art. For example, various flat-panel displays of varying size are available for use as a television or computer monitor.

The display 110 may also be configured to display images in three dimensions. Various flat-panel displays are available to show images in three dimensions.

For example, the display 110 may be a flat-panel LCD from Dimension Technologies Inc. of Rochester, N.Y., which can display images in two dimensions and three dimensions. Examples of this type of technology are disclosed in U.S. Pat. Nos. 5,500,765 and 6,157,424, both of which are assigned to Dimension Technologies, Inc. This type of three-dimensional display does not require the use of headgear (e.g. a head set or stereo glasses) by the user to see the three dimensions shown on the display.

In another embodiment, the display 110 may be a 50" 4D-50® PDP plasma flat-panel display from 4D-Vision GmbH in Jena, Germany, which can also display images in two and three dimensions without headgear. Other flat-panel displays, such as displays from Stereographics Corporation of San Rafael, Calif., may also be used without departing from the spirit of the invention.

B. Controller

As shown in the cross-sectional view of FIG. 3, the controller 400 may be disposed within the hearth 155 and may be accessed through a door 156 (see FIG. 1). The controller 400, as shown more particularly in FIG. 4, may include a plurality of modules, including a storage media 410, decoder 420, decompressor 430, auxiliary port 440, and user interface 450.

The storage media 410 may be any known media that can be used to store data. For example, the storage media 410 may be a hard disk drive for reading from and writing to a hard disk, a magnetic disk drive for reading from or writing to a removable magnetic disk, and/or an optical disk drive for reading from or writing to a removable optical disk such as a CD-ROM, DVD, or other optical media. Other types of media capable of storing data can also be used, such as, for example, magnetic cassettes, flash memory cards, digital video disks, Bernoulli cartridges, random access memories (RAMs), and read only memories (ROMs).

The decoder 420 and decompressor 430 may be coupled to the storage media 410. The decoder 420 may decode data from the storage media 410 and the decompressor 430 may decompress the data. The decoded and decompressed data may then be delivered to the display 110 for viewing. Alternatively, if the data is not compressed, the decompressor 430 may not be required. In the example embodiment, the data may be images of a fire, although other data may also be decoded, decompressed, and shown by the display 110. Hardware and software for decoding and decompressing data are well known in the art. For example, Dynamic Digital Depth Inc. of Santa Monica, Calif., offers several systems for decoding and decompressing data for display in three dimensions.

The controller 400 may also optionally include an auxiliary port 440 configured to accept data from one or more peripheral components 480 that may be coupled to the controller 400. For example, in one embodiment, the peripheral component 480 may be a DVD player for delivering DVD content to be shown on the display 110, such as movies and other types of video. In other embodiments, the peripheral component 480 may be a television tuner to deliver broadcast, cable, satellite, or other video content, a computer to deliver images typically displayed on a computer monitor, a gaming system to deliver images of a game, or any other peripheral component that may drive the display 110. In this manner, the fireplace 100 may function as more than just a simulated fireplace, but also as a display for showing content in two and/or three dimensions, as described further below. Although the peripheral component 480 is shown coupled to the controller 400 in the example embodiment, the peripheral component 480 may also, in an alternative embodiment, be directly connected to the display 110.

The auxiliary port 440 can also be configured with a modem or Ethernet card to allow the controller 400 to interact over an LAN, WAN, or the Internet to download and show new images of, for example, a fire or other desired images. These images may be pushed down to the controller 400 at a specified interval or may be pulled down by a user as desired.

The controller 400 also includes the user interface module 450, described in detail in the next section.

In an alternative embodiment, the controller 400 may be replaced with a computer, in a local or remote location, that may perform functions similar or identical to those of the controller 400.

C. User Interface

A user interface, such as the user interface module 450, may also be included with the fireplace 100 to allow a user to configure the fireplace 100 as desired. The user interface 450 may be implemented using hardware, software, or a combination of components. The user interface 450 may be displayed on the display 110, and a user may interact with the user interface using one or more input devices, such as a keyboard, mouse, remote control, or other device.

Figure 5:
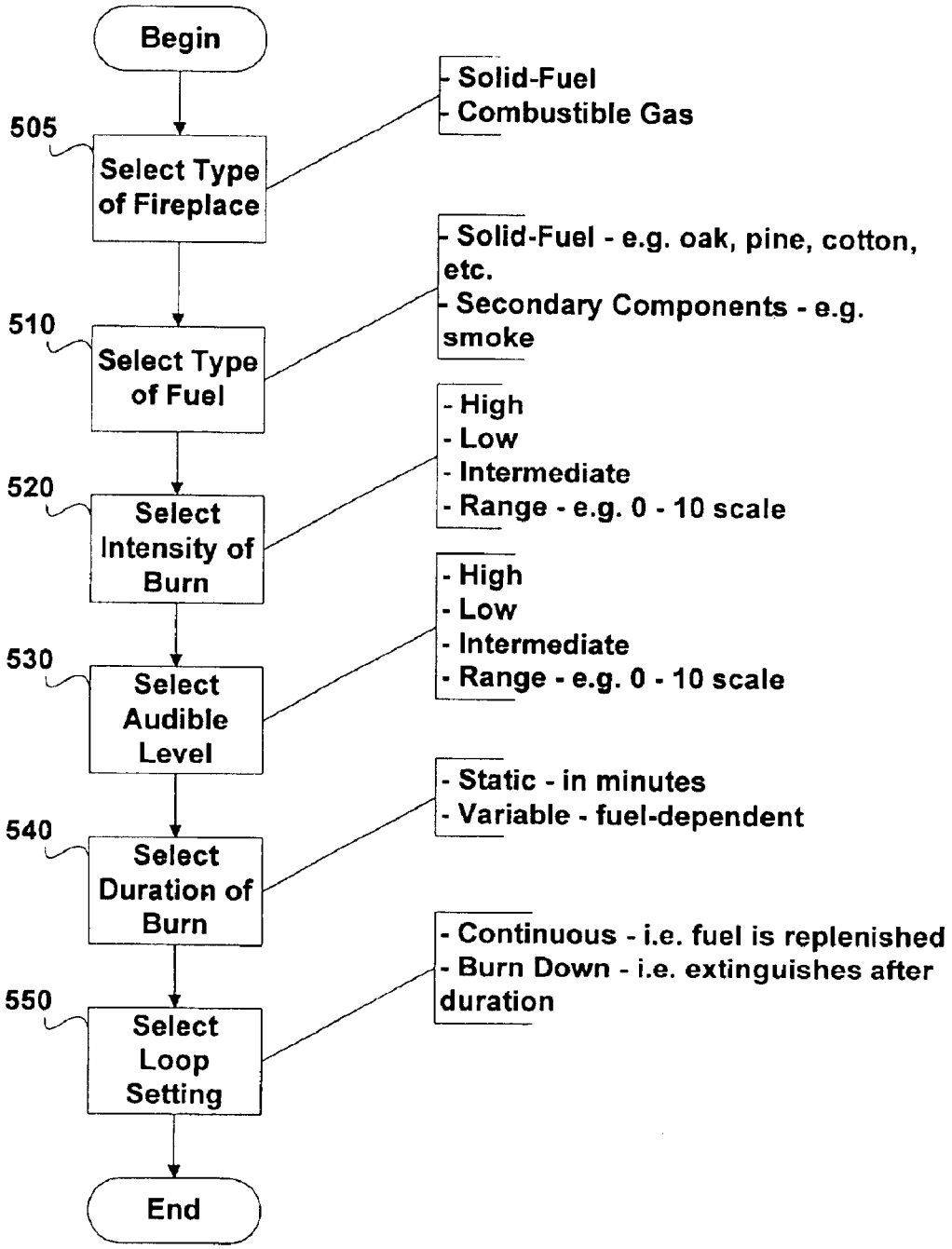
FIG. 5 illustrates an example system including operations of a user interface used to configure an example fireplace made in accordance with the present invention.

For example, a system illustrating example operations of one embodiment of a user interface is shown in FIG. 5. The system may be used to select one or more fire parameters used to configure the fire shown on the display 110. As used herein, the phrase "fire parameters" means one or more variables that may be configured by a user to customize the fire shown by the display 110. The fire parameters may include, without limitation, fire type, fuel type, burn intensity, audible level, and/or burn duration.

In operation 505 of the system, the desired type of fireplace is selected. For example, the user may select between a solid-fuel burning fireplace and a combustible gas fireplace. Depending on the type of fireplace selected, the controller 400 can select among data of various images stored on the storage media 410.

If a solid-fuel fireplace is chosen, in operation 510 the user may select the type of fuel desired to be shown. For example, the user may select between such fuel as oak, pine, cottonwood, etc. In addition, secondary components such as, for example, the amount of smoke displayed, can also be configured.

In operation 520, the intensity of the burn shown on the display 110 is configured. For example, selections such as high, intermediate, or low intensity can be selected. Alternatively, a range, such as from 1–10, may also be used for enhanced configurability.

In operation 530, the audible level is configured. Once again, selections such as high, intermediate, low, or a range may be provided. In an alternative embodiment, selection between different sounds such as, for example, crackling, hissing, and/or popping, may also be done in operation 530.

In operation 540, the duration of the burn is configured. For example, if a fire of a particular length is desired, a duration in minutes or hours may be entered. Alternatively, if a more realistic effect is desired, the duration of the burn can be set to reflect the natural duration of a fire dependent, for example, on the type of fuel selected in operation 510. For example, certain types of solid fuel may burn more slowly than others and therefore would have a longer duration of burn.

In operation 550, the user may select the loop setting. For example, the user may select a continuous setting in which the fire is continually replenished and maintained at a given intensity as set in operation 520. Alternatively, if the burn down setting is selected, the fireplace 100 may turn off automatically after the duration of burn set in operation 540 has been reached.

The system 500 and operations 505-550 are provided as an example, and other operations may be used without departing from the spirit of the invention. For example, an operation allowing a user to configure the color of the flames shown, or the style of the grate shown, may also be used.

D. Creation and Manipulation of Images

The three-dimensional images of a fire that can be shown on the display 110 may be created using a variety of techniques. The images may be filmed using, for example, a typical video recorder or similar device and then converted into data that can be shown in three dimensions. Alternatively, the images can be filmed in three dimensions or generated electronically using, for example, a computer.

There are several systems that are commercially available to convert two-dimensional video into three dimensions. For example, Dynamic Digital Depth Inc. of Santa Monica, Calif., offers hardware and software that can be used to convert images recorded in two dimensions into three-dimensional content that can be shown on a display, such as the display 110. Therefore, to create the images to be used in the fireplace 100, it is only necessary to film one or more fires and then convert the images to three-dimensional images. Once created, the three-dimensional images may be stored on the storage media 410.

In addition to creating the three-dimensional images, software on the controller 400 may be utilized to manipulate the images. For example, depending on the duration of the burn selected in operation 540, software on the controller 400 may use a video-editing technique called "tweening" or "in-betweening," wherein individual image frames may be manipulated (e.g., added or subtracted) to shorten, lengthen, and/or blend various content to a desired length.

E. Optional Components

As shown in FIGS. 1–3, a decorative facade may surround the display 100. The decorative facade 150 consists of a plurality of components, including trim 152, hearth 155, and a front panel 162 including doors 160 and 161. The trim 152 and hearth 155 are configured to abut a wall 180 to simulate a fireplace disposed within the wall 180. The trim 152 may be tapered, such as with a staircase effect, to create an appearance of depth. The front panel 162 and doors 160 and 161 may include transparent material, for example, glass, to allow the display 110 to be viewed through the doors 160 and 161 when the doors are closed. Alternatively, a mesh material (not shown) may be moveably mounted in front of the front panel 162. The hearth 155 includes the door 156 to allow access to the controller 400 (shown in FIG. 3).

One or more of the components of the decorative facade 150 may be eliminated, and additional components may be added, without departing from the scope of the invention. For example, if the hearth 155 is eliminated, the controller 400 may be disposed within the trim 152 or within the display 110 itself.

Also shown coupled to the front of the hearth 155 is a pair of speakers 171 and 172. The speakers 171 and 172 may be coupled to and driven by the controller 400 and may produce sounds consistent with the images shown on the display 110. For example, if images of a fire are shown, the speakers 171 and 172 may be used to produce sounds consistent with a fire, such as, for example, crackling, hissing, and/or popping noises.

Also included on the front of the hearth 155 is a receiver 185 for receiving signals from one or more remote controls that can be used to control the fireplace 100. The receiver 185 may be configured, for example, to receive an infrared signal from a remote control. The remote control may be used, for example, to turn the fireplace 100 on and off and to select various fire parameters through the user interface 450.

The front panel 162 can also be used to generate heat. A convertible heated glass apparatus (not shown) can form a front wall of the fireplace 100. The apparatus includes a phase change material that converts between an opaque solid and a less opaque liquid. When the phase change material is an opaque solid, an observer cannot view through the glass into the display 110. The convertible heated glass apparatus can be obtained from Pleotint L.L.C. located in West Olive, Mich., under the product name ThermoSee™.

One or more electric heating elements (not shown) having an associated blower can be disposed within the fireplace 100 to further generate and provide heat. For example, the heating elements may be disposed within the hearth 155, and one or more blowers may be used to move the air heated by the heating elements out into the room.

The fireplace 100 may be advantageous for several reasons. Because the fireplace 100 does not require an enclosure within which to be disposed, the fireplace 100 may be placed against any wall of a structure and may further be moved as desired. The fireplace 100 is compact in size to save space. Further, the display 110 of the fireplace 100 may be used to display images from sources other than the controller 400, as is described in more detail below.

II. Second Embodiment

Figure 6:
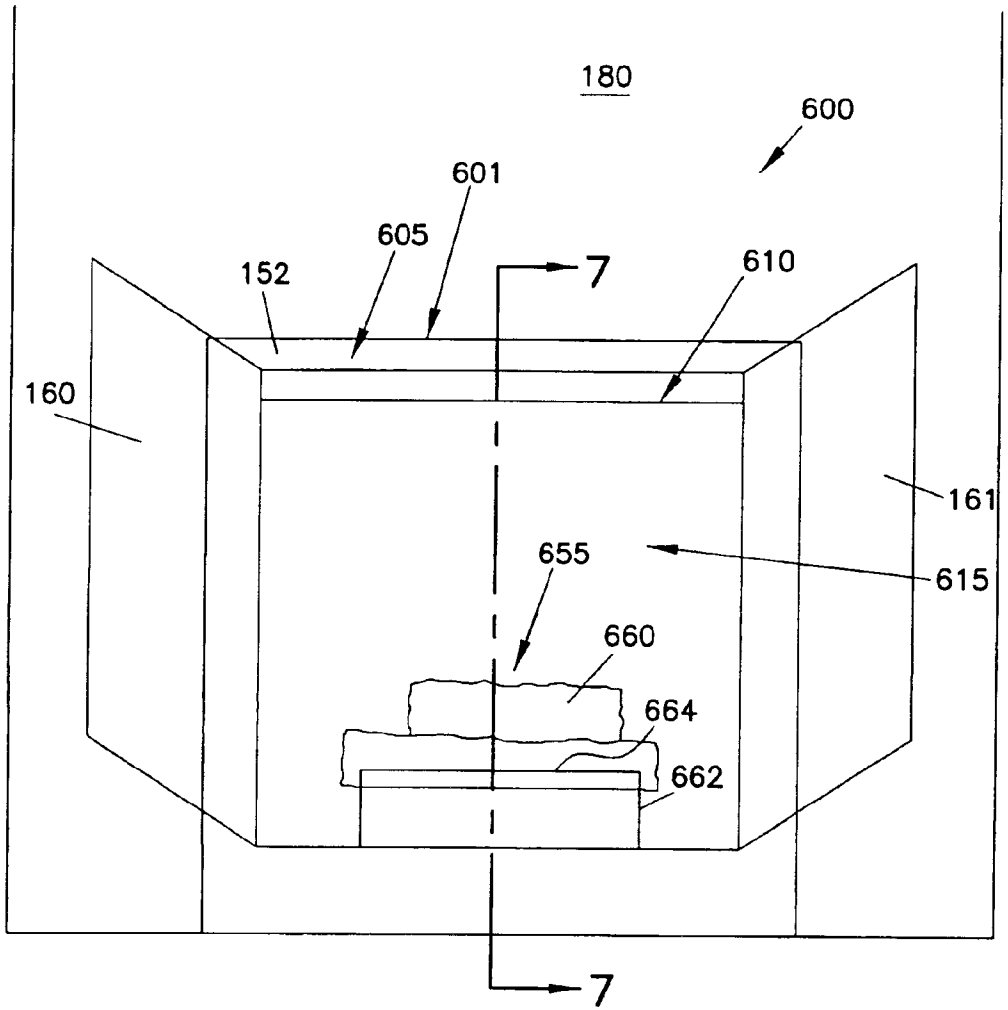
FIG. 6 is schematic front view of another embodiment of an example fireplace made in accordance with the present invention.
Figure 7:
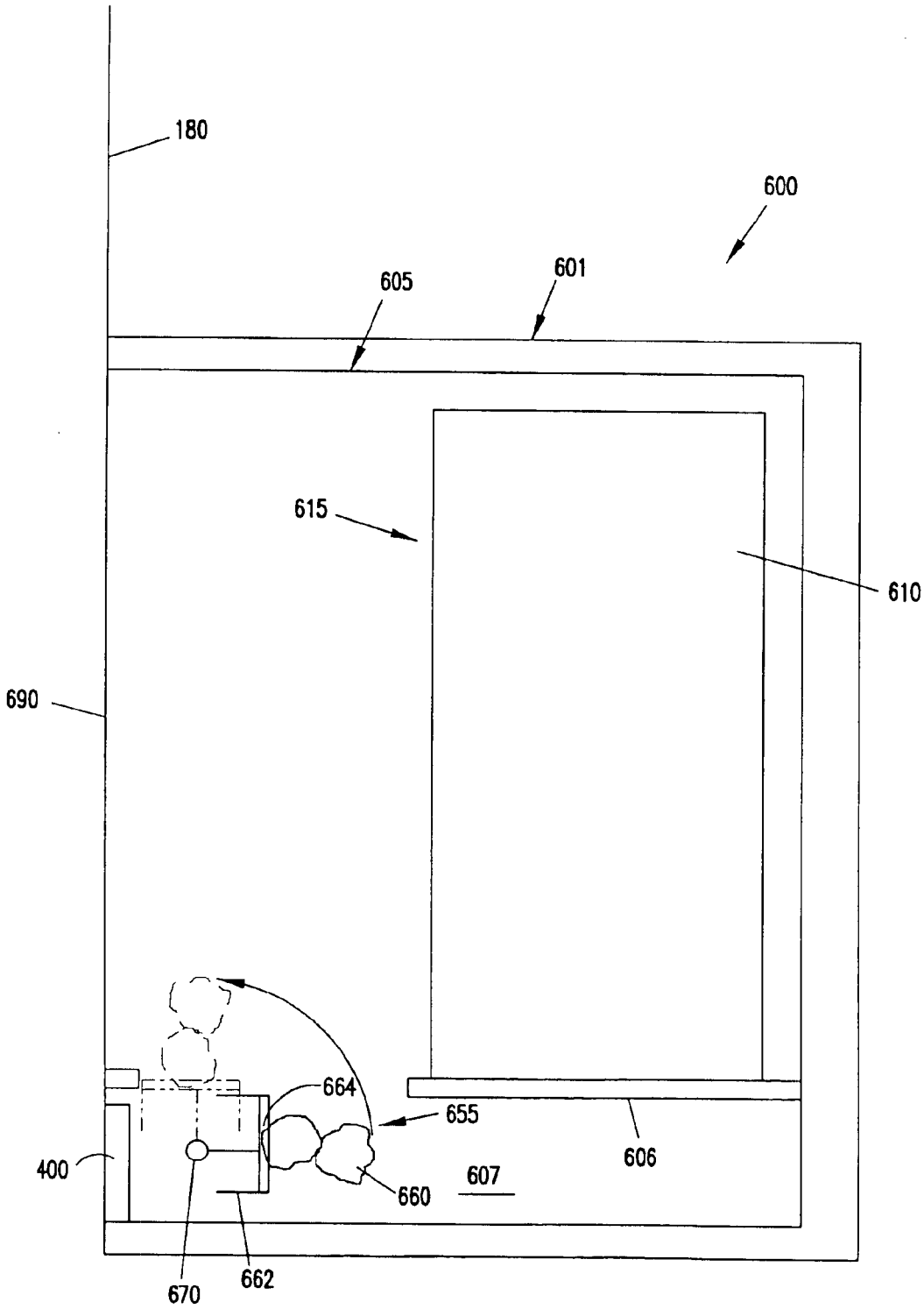
FIG. 7 is a schematic cross-sectional view of the fireplace taken along line 7—7 of FIG. 6.

A second example embodiment of a fireplace 600 is shown in FIGS. 6 and 7. The fireplace 600 is similar to that of fireplace 100, and like components have been numbered with identical numerals. The fireplace 600 is disposed within wall 180 of the structure which defines an aperture 601. The fireplace 600 includes an enclosure 605 and floor 606. A display 610 is disposed on the floor 606. The display 610, as well as other components of the fireplace 600, are described in detail below.

A. Display

The display 610, with screen 615, may be a flat-panel display as described with reference to fireplace 100. Alternatively, the display 610 may also be a cathode ray tube (CRT) display, a projection display, or other similar type of display. The display 610 may be larger than a flat-panel display because the enclosure 605 may accommodate a display having a footprint larger than that of a flat-panel display. The display 610 may show images in two and/or three-dimensions, as desired.

B. Optional Components

Also included in the enclosure 605 of the fireplace 600 is a system 655 including an artificial log set 660, a grate 662, and a simulated electric glowing ember system 664. The system 655 is coupled to a motor 670 that moves the system 655 into position in front of the display 610, as shown in FIG. 6, and also out of sight into an area 607 below the display 610, as shown in FIG. 7, when desired. This may be advantageous in that the system 655 may enhance the effect of the fireplace 600 when the display 610 shows images of a fire, and the system 655 may be moved out of view of the display 610 when the display 610 is driven by other peripheral components such as, for example, a television tuner or computer to show images other than a fire.

In addition, the display 610 may also be coupled to a motor (not shown) to move the display 610 forward and backward within the enclosure 605. For example, when the display 610 is used to simulate a fire, it may be advantageous to have the display 610 positioned nearer a back of the enclosure 605, as shown in FIG. 7, to further enhance the illusion of depth. When the display 610 is used for other purposes, such as a television or computer monitor, the display 610 can be moved to a front 690 of the enclosure 605 to allow the display 610 to be viewed more easily.

The fireplace 600 may be advantageous for several reasons. The fireplace 600, with the system 655, can further enhance the simulated effects and depth of a fireplace. In addition, the display 610 may be retrofitted into existing fireplace enclosures, such as solid-fuel, gas, and electric fireplaces.

III. Alternative Embodiments

A. Other Images

As indicated above, the example displays 110 and 610 may be used to display images other than that of fire. For example the displays may be used to display images of an aquarium, nature scene, artwork, or function as a virtual window when used in conjunction with a video capture device such as a video camera mounted outside a structure.

In addition, components other than the controller 400 can be used to drive the display. For example, the display may be driven by a computer to display, for instance, images from the Internet; a game system; a television tuner, cable, satellite, or other video feed; a DVD player, a CD player; a VCR; and/or a laserdisc player. Other peripheral components that can drive a display may also be used in conjunction with the displays 110 and 610.

B. Other Systems

Use of a three dimensional display, such as the displays 110 and 610, is not limited to use in a fireplace. The displays may also be used in a variety of other contexts around the home and/or office. For example, the displays may be used for the promotion of sales and marketing; as a communication tool in conference rooms, such as to present three-dimensional Microsoft PowerPoint presentations; in informational kiosks in malls and airports; and in the classroom. It may be advantageous to use a three-dimensional display to present information in a way that allows viewers to retain more information than if the information is presented in two dimensions.

The systems and methods of the present disclosure can be implemented using a system as shown in the various figures disclosed herein comprising various devices and/or programmers. Accordingly, the methods of the present disclosure can be implemented: (1) as a sequence of computer implemented steps running on the system; and (2) as interconnected modules within the system.

The implementation is a matter of choice dependent on the performance requirements of the system implementing the method of the present disclosure and the components selected by or utilized by the users of the method. Accordingly, the logical operations making up the embodiments of the method of the present disclosure described herein can be referred to variously as operations, steps, or modules. It will be recognized by one of ordinary skill in the art that the operations, steps, and modules may be implemented in software, in firmware, in special purpose digital logic, analog circuits, and any combination thereof without deviating from the spirit and scope of the present invention as recited within the claims attached hereto.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A simulated fireplace comprising:

a flat-panel display device configured to display images of a simulated fire; and a controller coupled to the flat-panel display device to provide the flat-panel display device with three dimensional image signals of the simulated fire, the controller including a user interface;

wherein the user interface allows the user to select various fire parameters.

2. The fireplace of claim 1, wherein the controller is configured to convert two dimensional image signals into three dimensional image signals.

3. The fireplace of claim 2, wherein the controller includes a decoder configured to convert two dimensional image signals into three dimensional image signals.

4. The fireplace of claim 2, wherein the controller includes storage media to store the converted three dimensional image signals.

5. The fireplace of claim 1, wherein the flat-panel display device includes a plasma screen.

6. The fireplace of claim 1, wherein the flat-panel display device includes an LCD screen.

7. The fireplace of claim 1, wherein the flat-panel display device is further configured to be driven by a computer.

8. A The fireplace of claim 1, wherein the flat-panel display device is further configured to be driven by a peripheral component to show images in addition to the images of the simulated fire.

9. The fireplace of claim 1, wherein the controller includes a DVD player.

10. The fireplace of claim 1, wherein the controller includes a storage media to store the images of the simulated fire.

11. The fireplace of claim 1, further comprising a decorative facade surrounding the flat-panel display device.

12. The fireplace of claim 11, wherein the facade is tapered to create a three-dimensional effect.

13. The fireplace of claim 1, further comprising:

an enclosure within which the flat-panel display device is disposed; and an artificial log set.

14. The fireplace of claim 13, wherein the artificial log set is retractable.

15. The fireplace of claim 13, wherein the artificial log set is moveable between a first position, wherein the artificial log set is visible adjacent the flat-panel display device, and a second position, wherein the artificial log set is not visible adjacent the flat-panel display device.

16. The fireplace of claim 13, further comprising an artificial electric glowing ember bed system disposed in the enclosure.

17. The fireplace of claim 1, further comprising speakers coupled to the controller for producing audible sounds.

18. The fireplace of claim 1, wherein the user interface allows the user to select a type of fuel that is shown on the flat-panel display device for the images of the simulated fire.

19. The fireplace of claim 1, wherein die user interface allows the user to select a duration of the simulated fire.

20. A method of simulating a fireplace comprising steps of:

providing a flat-panel display configured to show images in three dimensions;

providing a decorative facade surrounding the flat-panel display;

configuring the flat-panel display and the decorative facade for placement adjacent a wall of a structure to simulate the fireplace;

driving the flat-panel display with three dimensional image signals of a fire image; and allowing a user to configure fire parameters.

21. The method of claim 20, further comprising a step of allowing a user to select a duration of burn.

22. The method of claim 20, further comprising a step of driving the flat-panel display device with a computer.

23. The method of claim 20, comprising a step of driving the flat-panel display device with a television tuner.

24. A method of simulating a fire using an flat-panel display device, a three dimensional image signal, and a user interface coupled to the tint-panel display, the method comprising steps of:

generating a three dimensional image of a fire on the flat-panel display device in response to the three dimensional image signal;

controlling the fire image via the user interface; and selecting fire parameters using the user interface.

25. The method of claim 24, further comprising a step of selecting a duration for the fire using the interface.

26. The method of claim 24, further comprising a step of selecting a type of fuel for the fire using the interface.

27. A simulated fireplace comprising:

a flat-panel display device configured to display images of a simulated fire;

a controller coupled to the flat-panel display device to provide the flat-panel display device with three dimensional image signals of the simulated fire;

an enclosure within which the flat-panel display device is disposed; and an artificial log set.

28. The fireplace of claim 27, wherein the artificial log set is retractable.

29. The fireplace of claim 27, wherein the artificial log set is moveable between a first position, wherein the artificial log set is visible adjacent the flat-panel display device, and a second position, wherein the artificial log set is not visible adjacent the flat-panel display device.

30. The fireplace of claim 27, further comprising an artificial electric glowing ember bed system disposed in the enclosure.

* * * * *